US011382398B2

(12) United States Patent
Woo et al.

(10) Patent No.: US 11,382,398 B2
(45) Date of Patent: Jul. 12, 2022

(54) COSMETIC CONTAINER

(71) Applicant: SAMHWA CO., LTD, Uiwang-si (KR)

(72) Inventors: Byung-Jin Woo, Gunpo-si (KR); Ki Sung Lee, Suwon-si (KR); Dong Su Shin, Anyang-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 17/185,849

(22) Filed: Feb. 25, 2021

(65) Prior Publication Data

US 2022/0104600 A1 Apr. 7, 2022

(30) Foreign Application Priority Data

Oct. 5, 2020 (KR) ..... 10-2020-0127808
Nov. 12, 2020 (KR) ..... 10-2020-0150814
Feb. 19, 2021 (KR) ..... 10-2021-0022253

(51) Int. Cl.

| | |
|---|---|
| ***A45D 34/00*** | (2006.01) |
| ***B65D 83/00*** | (2006.01) |
| ***B05B 11/02*** | (2006.01) |
| ***B05B 15/30*** | (2018.01) |
| ***B05B 11/00*** | (2006.01) |

(52) U.S. Cl.

CPC ..... *A45D 34/00* (2013.01); *B05B 11/02* (2013.01); *B05B 11/3043* (2013.01); *B65D 83/0005* (2013.01); *A45D 2200/055* (2013.01); *B05B 15/30* (2018.02)

(58) Field of Classification Search

CPC ..... A45D 34/00; A45D 2200/055; A45D 2034/005; B65D 83/0005; B05B 11/00416; B05B 11/00446; B05B 11/0054; B05B 11/02; B05B 11/3043; B05B 11/3045; B05B 11/3047; B05B 11/3046; B05B 15/30

See application file for complete search history.

(56) References Cited

U.S. PATENT DOCUMENTS

| | | | | |
|---|---|---|---|---|
| 3,420,413 | A * | 1/1969 | Corsette | B65D 55/02 222/499 |
| 9,908,130 | B2 * | 3/2018 | Moretti | B05B 11/3043 |
| 10,717,098 | B2 * | 7/2020 | Delmon | B05B 11/00416 |
| 11,084,646 | B1 * | 8/2021 | Hwang | B05B 11/0008 |
| 2004/0124212 | A1 * | 7/2004 | Masuda | B05B 11/00412 222/183 |
| 2011/0024452 | A1 * | 2/2011 | Moretti | B05B 11/3047 222/105 |

(Continued)

FOREIGN PATENT DOCUMENTS

| | | |
|---|---|---|
| KR | 20-0277187 Y1 | 6/2002 |
| KR | 10-1202284 B1 | 11/2012 |
| KR | 10-1963619 B1 | 3/2019 |

*Primary Examiner* — Patrick M. Buechner

(74) *Attorney, Agent, or Firm* — Park, Kim & Suh, LLC

(57) ABSTRACT

A cosmetic container includes an outer container, an inner container inserted into the outer container to receive a content injected therein, and a pump support coupled to an upper opening of the inner container and including a support body connecting to an inside of the inner container. The container further includes a pump inserted through the support body to discharge the content, and a shoulder coupled to an upper portion of the outer container to downwardly press the pump support with respect to the outer container.

13 Claims, 14 Drawing Sheets

(56) References Cited

U.S. PATENT DOCUMENTS

| | | | | |
|---|---|---|---|---|
| 2011/0095053 | A1* | 4/2011 | Greiner-Perth | B05B 11/00446 222/105 |
| 2014/0103068 | A1* | 4/2014 | Son | B65D 3/18 222/105 |
| 2014/0144943 | A1* | 5/2014 | Kim | B05B 11/3097 222/256 |
| 2017/0000237 | A1* | 1/2017 | Lefevre | A45D 40/0075 222/183 |
| 2017/0129690 | A1* | 5/2017 | Sugawara | B65D 83/38 |
| 2019/0060929 | A1* | 2/2019 | Delmon | B05B 11/0038 |
| 2020/0324306 | A1* | 10/2020 | Bilton | B05B 11/0054 |

* cited by examiner

COSMETIC CONTAINER

CROSS-REFERENCE TO RELATED APPLICATIONS

This application claims the benefit of Korean Patent Application No. 10-2020-0127808, filed with the Korean Intellectual Property Office on Oct. 5, 2020, Korean Patent Application No. 10-2020-0150814, filed with the Korean Intellectual Property Office on Nov. 12, 2020, and Korean Patent Application No. 10-2021-0022253, filed with the Korean Intellectual Property Office on Feb. 19, 2021. The disclosures of the above patent applications are incorporated herein by reference in their entirety.

BACKGROUND

1. Technical Field

The present invention relates to a cosmetic container that allows easy refills.

2. Description of the Related Art

To reduce environmental pollution and promote recycling, there is a growing demand for cosmetic containers that can be easily recycled or refilled. In particular, a recyclable cosmetic container can be fabricated entirely with the same material to facilitate recycling, for example by using a spring fabricated by plastic molding instead of the spring made of metal used in existing pumps. Also, by fabricating a cosmetic container with a replaceable part for refills, it is possible to reduce replacements costs and lower the recycling load.

Many cosmetic containers use a glass material for an aesthetic appearance. However, a container made from a glass material may be difficult to recycle compared to plastic containers and may entail a high fabrication cost.

SUMMARY OF THE INVENTION

The present invention was conceived to resolve the problems described above and carries the objective of providing a cosmetic container that allows easy refills.

Other objectives of the present invention will be more clearly appreciated from the embodiments described below.

One aspect of the invention provides a cosmetic container that includes: an outer container; an inner container separably inserted into the outer container and configured to receive a content injected therein; a pump support coupled to an upper opening of the inner container and including a support body connecting to an inside of the inner container; a pump inserted through the support body and configured to discharge the content; and a shoulder separably coupled to an upper portion of the outer container to downwardly press the pump support with respect to the outer container, where separating the shoulder from the outer container may separate the pump from the support body and thereby enable a replacing of the inner container and the pump support.

A cosmetic container according to an embodiment of the invention can include one or more of the following features. For example, the outer container can be fabricated from a plastic or glass material, and the inner container and the pump support can be fabricated from a plastic or glass material. It is possible for the inner container, pump support, pump, shoulder, and nozzle to all be fabricated from the same plastic material.

The inner container can include a flange formed around its periphery, the flange can be configured to catch onto an upper end of the outer container, and the pump support can include a coupling member that may be formed around the periphery of the support body and configured to catch onto an upper end of the inner container.

The pump can include a tube or can include a piston that is movably inserted within the inner container.

The pump can include a flange, support protrusions and mounting protrusions can be formed on the inner perimeter of the shoulder protrusion with the mounting protrusions formed in a particular interval below the support protrusions, and the flange can be positioned between the support protrusions and the mounting protrusions. A support protrusion can include a downwardly sloping surface.

A ring can be positioned between the inner container and the outer container. The pump support can include support protrusions that may be positioned between the outer container and the inner container.

The inner container can include an inner container head, the pump can include a flange positioned over an upper portion of the inner container head, and a packing can be positioned between the inner container head and the flange.

The inner container and the outer container can be formed as an integrated body.

An embodiment of the invention described above can provide various advantages, including the following. However, a structure can constitute an embodiment of the invention without necessarily providing all of the advantages below.

An embodiment of the invention can provide a cosmetic container that allows easy recycling and refilling.

DETAILED DESCRIPTION OF THE INVENTION

Figure 1:
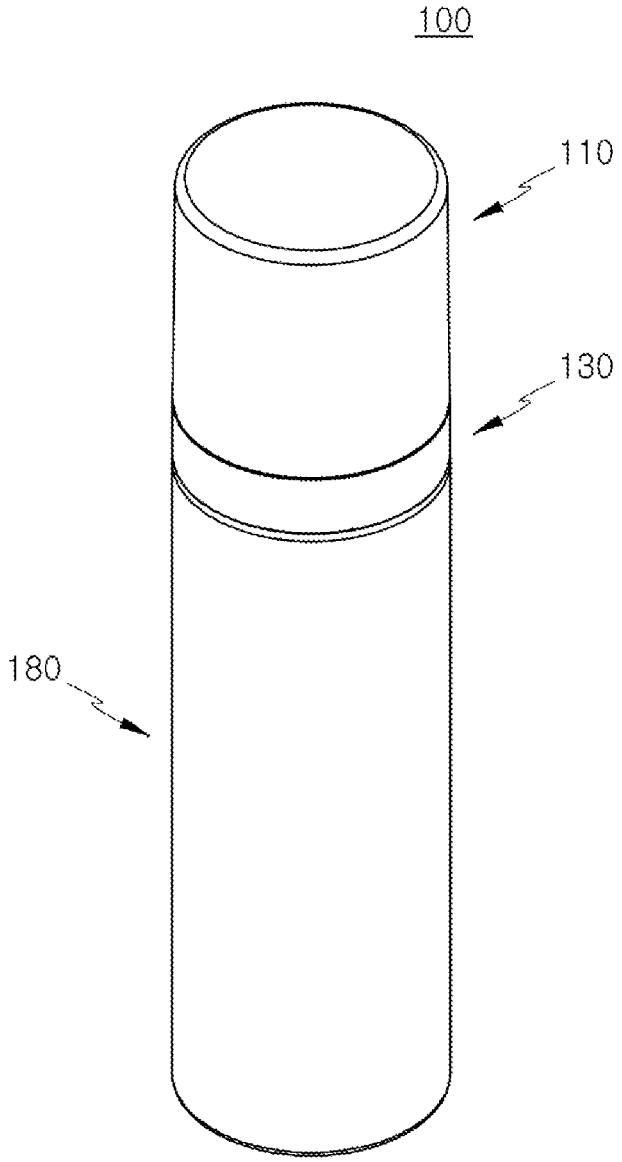
FIG. 1 is a perspective view illustrating a cosmetic container according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

While such terms as "first" and "second," etc., may be used to describe various components, such components must not be limited to the above terms. The above terms are used only to distinguish one component from another.

Certain embodiments of the invention will be described below in more detail with reference to the accompanying drawings. Those components that are the same or are in correspondence are rendered the same reference numeral, and redundant descriptions are omitted.

Figure 2:
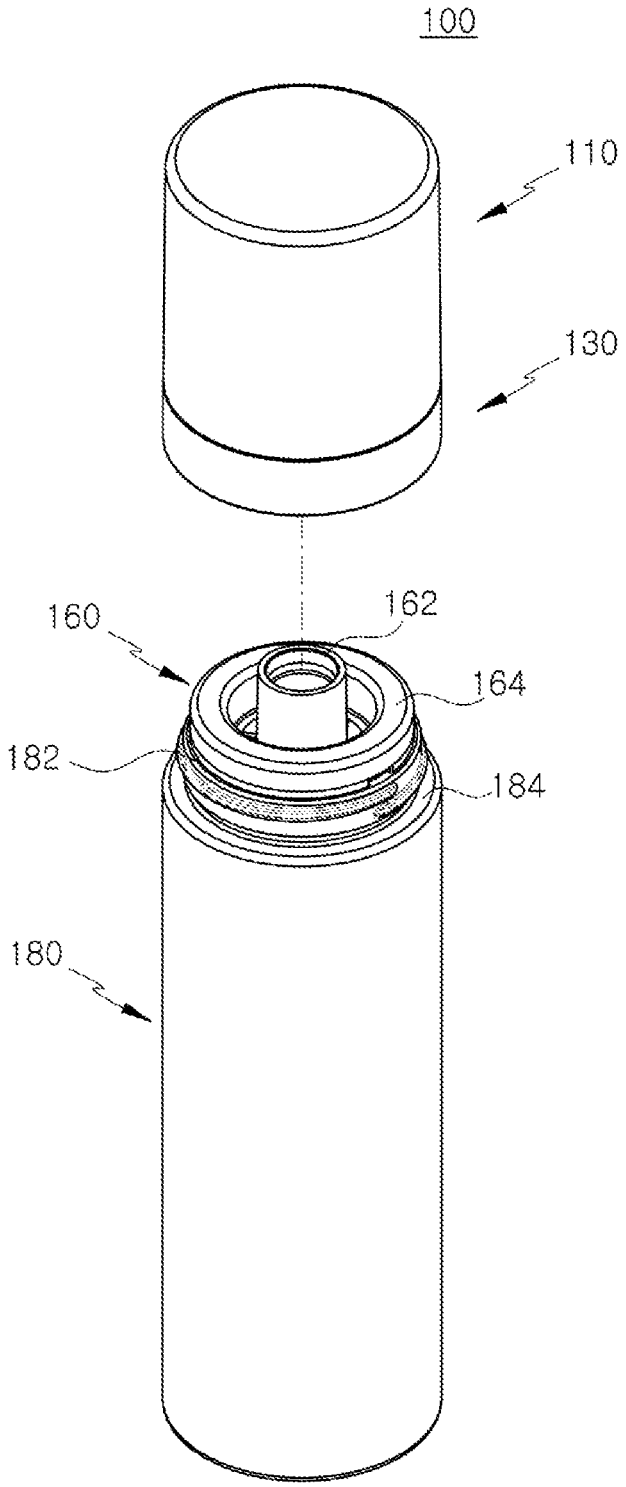
FIG. 2 is a perspective view of the cosmetic container shown in FIG. 1 with the overcap, shoulder, and pump separated.
Figure 3:
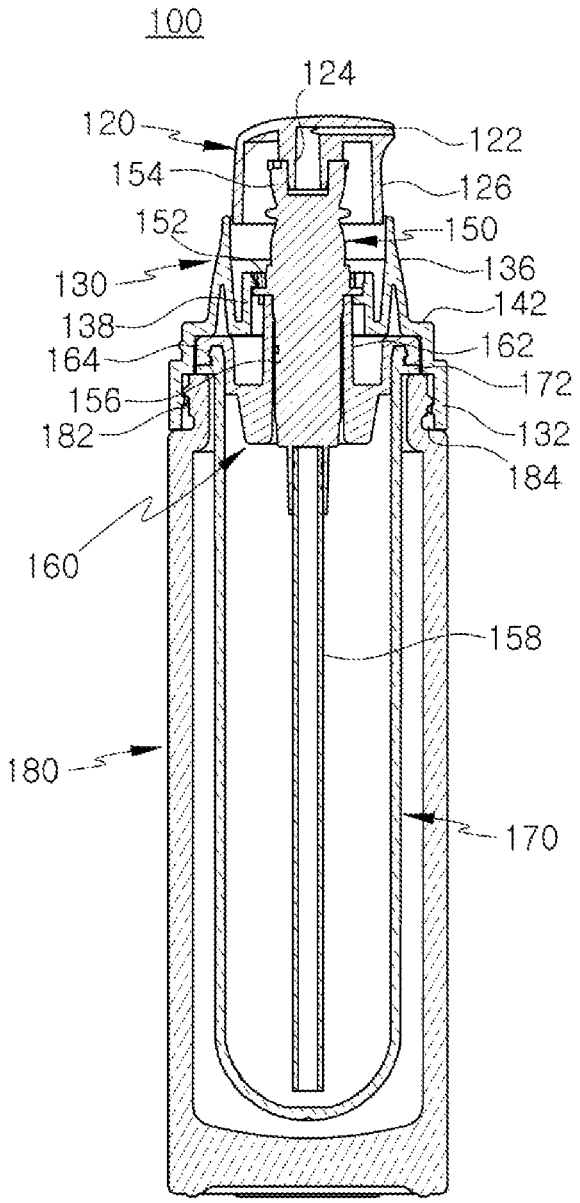
FIG. 3 is a vertical cross-sectional view cut across the center of the cosmetic container shown in FIG. 1 with the overcap excluded.
Figure 4:
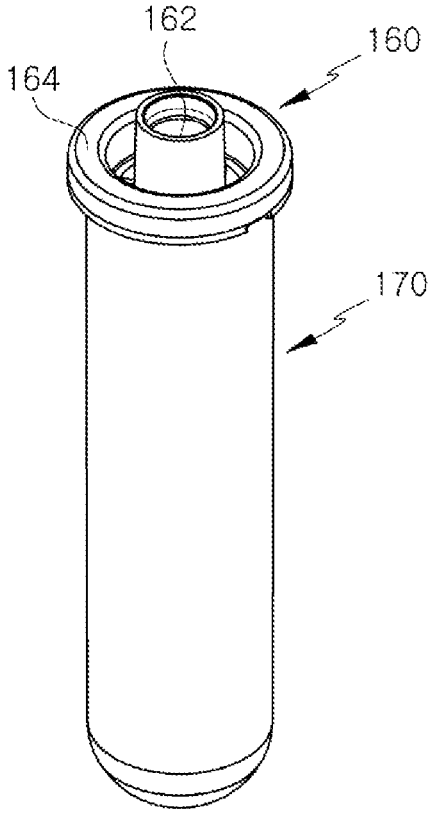
FIG. 4 is a perspective view illustrating an inner container and a pump support provided as a refill.
Figure 5:
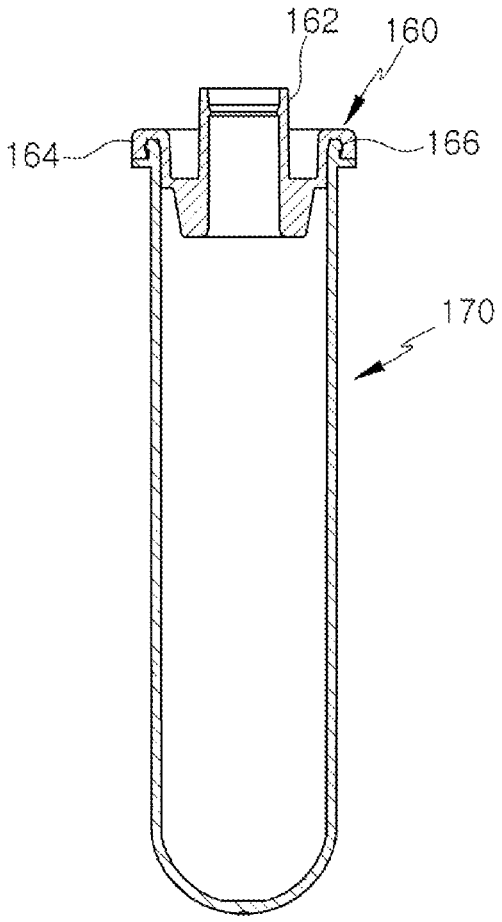
FIG. 5 is a vertical cross-sectional view cut across the center of the inner container and pump support shown in FIG. 4.

FIG. 1 is a perspective view illustrating a cosmetic container 100 according to a first disclosed embodiment of the invention, and FIG. 2 is a perspective view of the cosmetic container shown in FIG. 1 with the overcap 110, shoulder 130, and pump 150 separated. FIG. 3 is a vertical cross-sectional view cut across the center of the cosmetic container 100 shown in FIG. 1 with the overcap 110 excluded, FIG. 4 is a perspective view illustrating an inner container 170 and a pump support 160 provided as a refill, and FIG. 5 is a vertical cross-sectional view cut across the center of the inner container 170 and pump support 160 shown in FIG. 4.

Referring to FIGS. 1 to 5, a cosmetic container 100 according to a first disclosed embodiment may include an overcap 110, a nozzle 120, a shoulder 130, a pump 150, a pump support 160, an inner container 170, and an outer container 180. Here, the inner container 170, which may be filled with a content, and the pump support 160, which may be coupled to an upper portion of the inner container 170, can be replaced for a refill. Also, the remaining parts other than the inner container 170 and pump support 160 may all be recyclable.

Referring to FIG. 2, after the overcap 110, nozzle 120, pump 150 and shoulder 130 are separated from the outer container 180 and inner container 170, the assembly of the inner container 170 and pump support 160 can be separated from the outer container 180 and replaced with a new set.

The overcap 110 may form an upper part in the exterior of the cosmetic container 100 and may be shaped as a hollow cylinder having an open bottom and an upper surface. The entirety of the nozzle 120 and portions of the shoulder 130 and pump 150 may be encased within the overcap 110. A lower end of the overcap 110 may be positioned on a second curb 144 provided around a periphery of the shoulder 130.

The nozzle 120 may be coupled to an upper portion of the pump 150 to provide a passage through which the content discharged by the pump 150 may be ejected. To this end, the nozzle 120 may include a nozzle protrusion 124 that may be coupled with the valve 154 of the pump 150, where the nozzle protrusion 124 may connect with the discharge hole 122. The content pumped by the pump 150 can be discharged through the valve 154, nozzle protrusion 124, and discharge hole 122 to the outside.

The nozzle 120 can include a peripheral surface 126 and can have a circular horizontal cross section. The nozzle 120 may be structured to have an open bottom. Also, when the nozzle 120 is pressed down, the peripheral surface 126 can be inserted to the inside of the receptacle part 136 of the shoulder 130, and when the external force is removed, the nozzle may be returned to its original position as shown in FIG. 3 by the elastic restoring force of a spring (not shown) provided on the pump 150.

The pump 150 may be coupled to the pump support 160, which may be coupled to an upper portion of the inner container 170, to pump the content filled inside the inner container 170. The pump 150 may include a valve 154 and a housing 156, the structures and operations of which are well known in the art and thus are not described here in further detail. The pump 150 can, for example, have the same structure as the pump disclosed in Korean Registered Patent No. 1963619, but the present invention is not to be limited by the composition of the pump 150.

A flange 152 may be provided around the periphery of the housing 156, where the flange 152 can be caught on the upper end of the support body 162 and the mounting protrusions 140 of the shoulder 130. As a result, the pump 150 can be secured in place at an upper portion of the inner container 170.

A pump 150 according to this embodiment can include a tube 158. The tube 158 may be a hollow pipe of which one end can be coupled to the housing 156 and the other end can be positioned close to the bottom surface at the lower portion of the inner container 170. The suctioning force of the pump 150 can move the content through the tube 158 to the inside of the pump 150.

The outer container 180 may form the lower part of the exterior of the cosmetic container 100 and may have an empty space within. The inner container 170 may be inserted into the empty space inside the outer container 180. The shoulder 130 may be screw-joined onto an upper portion of the outer container 180. The outer container 180 can be formed with a diameter somewhat larger than that of the inner container 170, so that a particular gap can be formed between the inner container 170 and the outer container 180.

At an upper portion of the outer container 180, an outer container head 182 may be formed, which may have a smaller diameter compared to other portions of the outer container 180 and which may have a curb 184 formed at its lower end. A screw thread (no numeral assigned) may be formed in the outer perimeter of the outer container head 182, and this screw thread may engage the screw thread 134

(see FIG. 6) formed in the inner perimeter of the coupling part 132 of the shoulder 130 for the screw joint. The lower end of the shoulder 130 can be positioned on the curb 184 of the outer container.

The outer container 180 can be fabricated from a material (e.g. a transparent plastic, transparent glass, etc.) different from that of the other parts of the cosmetic container 100. In cases where the outer container 180 is fabricated from a transparent material, the inner container 170 would be visible from the outside, allowing the user to readily check the remaining amount of the content held in the inner container 170.

Of course, the outer container 180 can also be fabricated from the same material as the other parts of the cosmetic container 100.

The pump support 160 may be coupled to an upper portion of the inner container 170 and may serve to support the pump 150. The pump support 160 may include a support body 162, through which the pump 150 may be inserted, and a coupling member 164, which may be formed on the periphery of the support body 162 and which may be coupled to an upper portion of the inner container 170.

The support body 162 may have the shape of a hollow cylinder of which both the upper and lower ends are open, where the lower end may connect to the inside of the inner container 170. The pump 150 may be separably inserted through the inside of the support body 162. The support body 162 can have a particular length so as to prevent the pump 150 from being shaken or forming a gap and allow a stable manner of operation. Also, when coupled with the inner container 170, the support body 162 can have an upper portion thereof protruding over the upper portion of the inner container 170.

The coupling member 164 may be formed on the periphery of the support body 162 as an integrated part and with its edge formed in the shape of a ring and may be coupled to the upper portion of the inner container 170. A coupling groove 166 may be formed at the end portion of the coupling member 164, where the upper end of the inner container 170 may be coupled to the coupling groove 166 by press fitting, etc.

The inner container 170 may have the shape of a hollow cylinder, and a content may be filled in the empty space within. There is no limit to the type, form, and usage of the content filled in the inner container 170, and a cosmetic container 100 based on the present invention is not to be limited by the filled content.

The upper portion of the inner container 170 may have an opening, and onto this opening, the pump support 160 may be separably coupled. At an upper portion on the outer perimeter of the inner container 170, a flange 172 may be formed, which may be caught on the upper end of the outer container 180.

When the content filled in the inner container 170 is used up completely or to an amount that makes further use difficult, the inner container 170 and pump support 160 can be separated and removed from the other parts and replaced with another inner container 170 filled with the content. Here, the refill inner container 170 can have a pump support 160 coupled to its upper portion, and a separate plug (not shown) can be coupled at the center of the support body 162 formed in the center of the pump support 160. The separate plug can be removed when the inner container 170 and pump support 160 are coupled to the outer container 180.

The lower portion of the inner container 170 may have a hollow spherical shape instead of being formed flat, so that the content can be used through the tube 158 until there is no or a minimal amount remaining.

Figure 6:
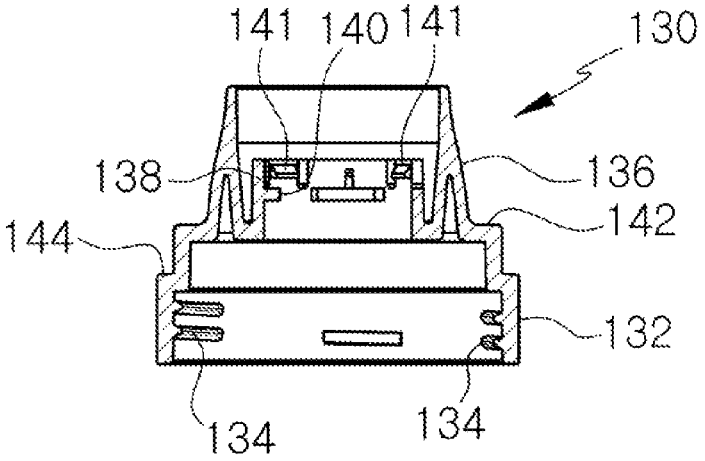
FIG. 6 is a cross-sectional view illustrating a shoulder.

FIG. 6 is a cross-sectional view illustrating the shoulder 130.

Referring to FIG. 3 and FIG. 6, the shoulder 130 may be coupled to the outer container head 182 corresponding to the upper portion of the outer container 180, to thereby couple the pump support 160 and inner container 170 to the outer container 180 and couple the pump 150 to the pump support 160. The shoulder 130 may include a coupling part 132, two curbs 142, 144, and a receptacle part 136, with the diameters gradually decreased from the coupling part 132 positioned at the bottom towards the receptacle part 136 positioned at the top.

The coupling part 132 may be structured to have the shape of a hollow cylinder with both the upper end and lower end open. The coupling part 132 may correspond to the portion of the shoulder 130 having the largest diameter. A screw thread 134 may be formed in the inner perimeter of the coupling part 132, and this screw thread 134 may be screw-joined with the screw thread formed in the outer perimeter of the outer container head 182.

At an upper portion of the coupling part 132, a second curb 144 and a first curb 142 may sequentially be formed. The diameter of the shoulder 130 may be gradually decreased by each of the curbs 142, 144. A horizontal plane formed by the first curb 142 may press down on the coupling member 164 of the pump support 160, so that the pump support 160 can be coupled to the upper end of the inner container 170 in a stable manner.

At an upper portion of the first curb 142, a receptacle part 136 can be formed that has the shape of a hollow column which is gradually decreased in diameter towards the top. The upper end and lower end of the receptacle part 136 may both be open, and on the inside, there may be formed a shoulder protrusion 138 that is shaped as a hollow cylinder.

The shoulder protrusion 138 may be connected with the inner perimeter of the receptacle part 136 and may have a length shorter than that of the receptacle part 136. On the inner perimeter of the shoulder protrusion 138, a multiple number of mounting protrusions 140 may be formed in a particular interval. The end portions of the mounting protrusions 140 can be in contact with the outer perimeter of an upper portion of the support body 162, and the flange 152 of the pump 150 can be positioned on the upper surfaces.

On the inner perimeter of the shoulder protrusion 138, inwardly protruding support protrusions 141 can be formed in a particular interval. The upper surface of a support protrusion 141 may form a downwardly sloping surface. The mounting protrusions 140 may be formed in a particular interval below the support protrusions 141.

When the pump 150 is coupled to the shoulder 130, the flange 152 may pass over the sloping surfaces of the support protrusions 141 to be mounted on the mounting protrusions 140. Thus, as the flange 152 of the pump 150 is positioned in the gap between the support protrusions 141 and the mounting protrusions 140, the pump 150 and the shoulder 130 can be coupled and separated as an integrated body. Therefore, when the shoulder 130 is separated for a refill, the pump 150 can be separated together.

A cosmetic container 100 according to the first disclosed embodiment can have the overcap 110, nozzle 120, shoulder 130, pump 150, pump support 160, and inner container 170, with the exception of the outer container 180, all formed from a same plastic material such as, for example, polypropylene.

Referring to FIG. 2, when the inner container 170 is replaced with a refill, the plug (not shown) coupled to the support body 162 of the pump support 160 may be removed, and then the assembly of the pump 150, shoulder 130, nozzle 120, and overcap 110 may be coupled as in FIG. 2 to complete the replacement of the refill container.

Figure 7:
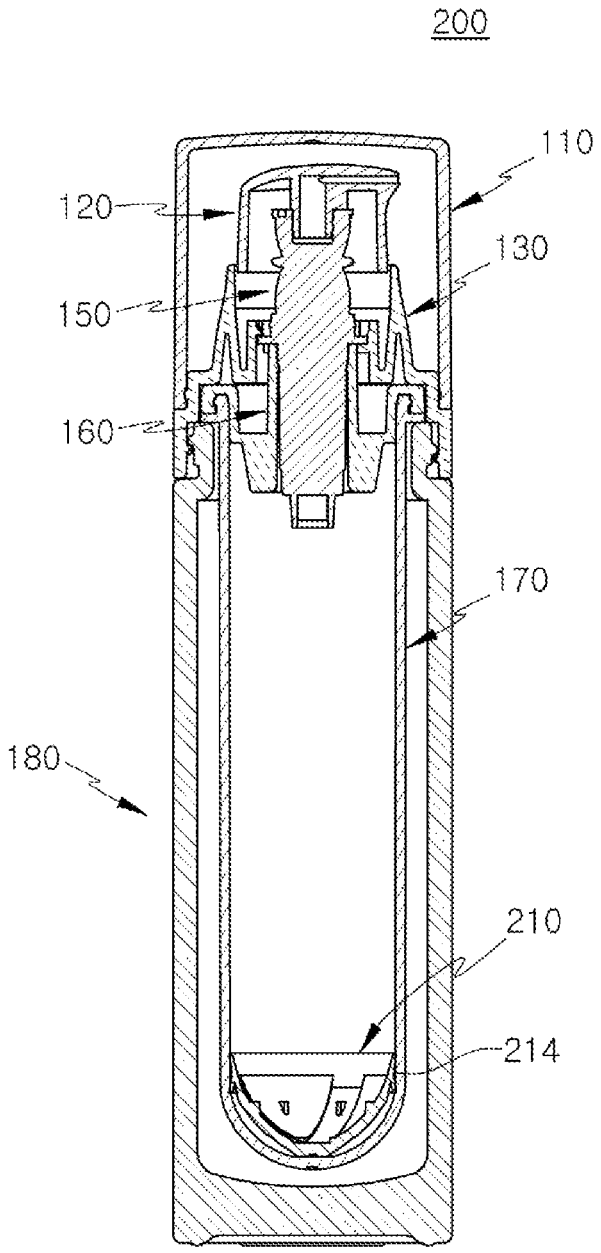
FIG. 7 is a cross-sectional view illustrating a cosmetic container according to a second disclosed embodiment of the invention.
Figure 8:
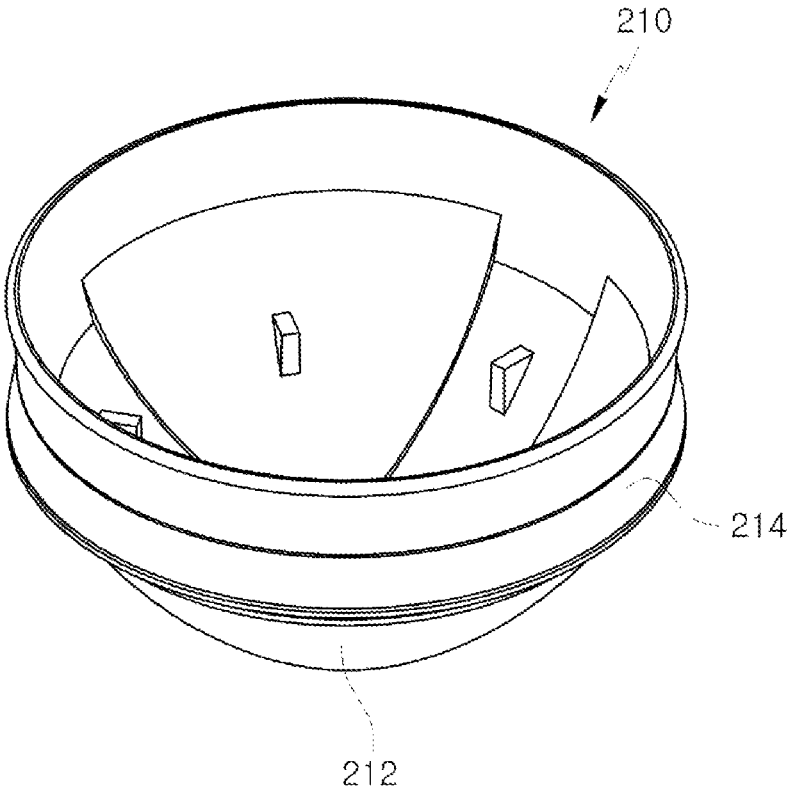
FIG. 8 is a perspective view illustrating the piston of the cosmetic container shown in FIG. 7.

FIG. 7 is a cross-sectional view illustrating a cosmetic container 200 according to a second disclosed embodiment of the invention. FIG. 8 is a perspective view illustrating the piston 210 of the cosmetic container shown in FIG. 7, and FIG. 9 is a cross-sectional view of the piston shown in FIG. 8.

Figure 9:
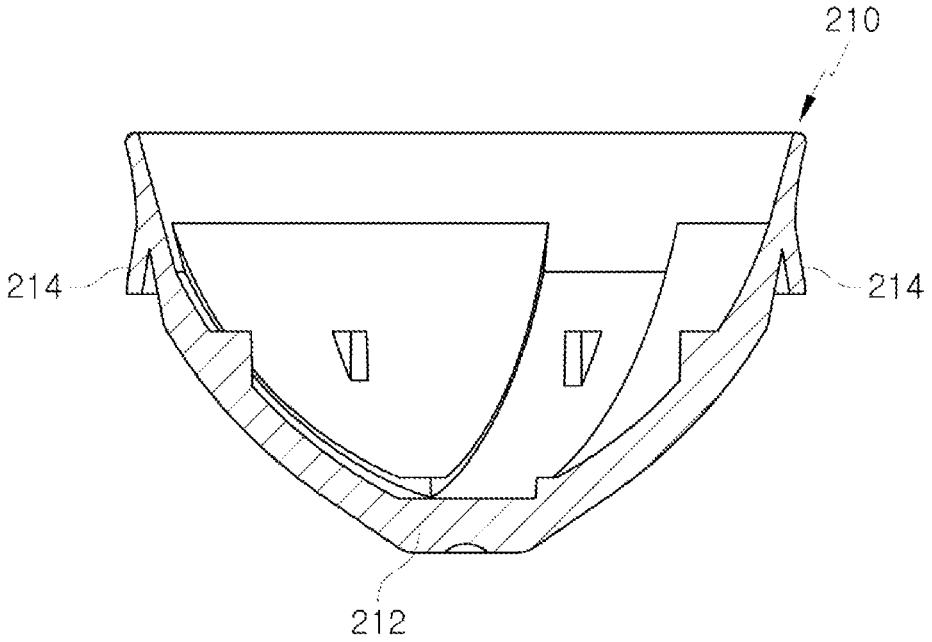
FIG. 9 is a cross-sectional view of the piston shown in FIG. 8.

Referring to FIGS. 7 to 9, a cosmetic container 200 according to the second disclosed embodiment may differ from a cosmetic container 100 according to the first disclosed embodiment in that the pump 150 may have the tube 158 removed and instead may include a piston 210. A cosmetic container 200 according to the second disclosed embodiment may have the structure of an airless pump, in which the piston 210 rises when the content is discharged by the operation of the pump 150 and the amount remaining in the inner container 170 is decreased. Such airless pump corresponds to general technology, disclosed in Korean Registered Patent No. 1202284, etc., and thus is not described here in further detail. At a lower portion of the inner container 170, an air hole (not shown) may be formed for allowing the rising of the piston 210.

The piston 210 may be configured to be raised and lowered while maintaining tight contact with the inner perimeter of the inner container 170 and may include a piston body 212 having a semispherical shape and a contact member 214 formed at an upper end of the piston body 212.

The piston body 212 may have the shape of a hemisphere with an empty space therein, and the piston body 212 having such a shape can be readily deformed (elastically compressed) to enable the contact member 214 to more tightly contact the inner perimeter of the inner container 170. In particular, compared to the piston disclosed in Korean Registered Patent No. 1202284 in which a contact member is formed around the peripheral surface of a hollow cylinder, the structure having a semispherical shape as in this embodiment may provide the advantage of allowing easier elastic deformations.

The contact member 214 may be formed at the upper end of the piston body 212. The contact member 214 may be formed thinly so as to tightly contact the inner perimeter of the inner container 170, and as a result, the contact member 214 may be readily deformed.

A cosmetic container 200 according to the second disclosed embodiment can also be refilled by removing the assembly of the inner container 170 and pump support 160 and replacing these with a refill, in the same manner as for the first disclosed embodiment.

Figure 10:
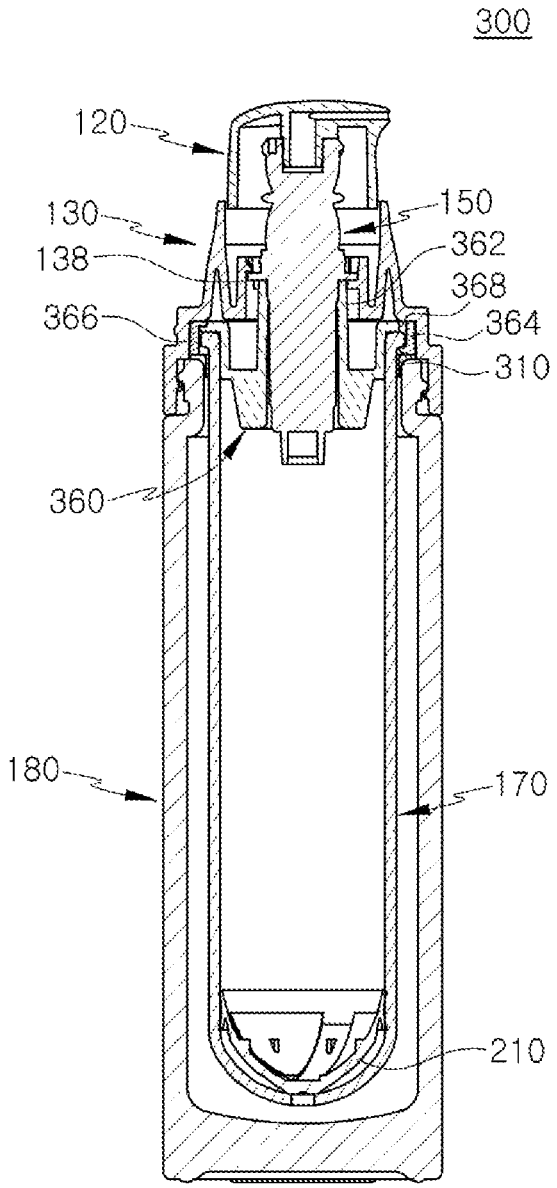
FIG. 10 is a cross-sectional view illustrating a cosmetic container according to a third disclosed embodiment of the invention.

FIG. 10 is a cross-sectional view illustrating a cosmetic container 300 according to a third disclosed embodiment of the invention.

Incidentally, although the cosmetic container 300 shown in FIG. 10 is illustrated as an airless type having a piston 210, the cosmetic container can obviously also be implemented as one having a tube 158.

Referring to FIG. 10, a cosmetic container 300 according to the third disclosed embodiment may be the same as or similar to a cosmetic container 200 according to the second disclosed embodiment, and as such, the following will focus on the differences.

A cosmetic container 300 according to the third disclosed embodiment may include a ring 310 between the inner container 170 and the outer container 180. The ring 310 may be placed between an outer container 180 and an inner container 170 fabricated from a glass material to prevent the glass material from being damaged by an impact. The ring 310 can be fabricated from a material that is softer than glass, such as plastic, rubber, silicone, etc. The ring 310 may have a cross section shaped as an inverted "L" and may be inserted onto the upper end of the outer container 180.

The pump support 360 may have the pump 150 coupled inside and may be the same as the pump support 160 according to the first disclosed embodiment in terms of including a support body 362, a coupling member 364, and a coupling groove 366. However, the pump support 360 of a cosmetic container 300 according to the third disclosed embodiment may be distinguished by including an air hole 368.

The air hole 368 allows outside air to enter between the outer container 180 and the inner container 170. As a result, air can enter the inside of the inner container 170 through the hole (no numeral assigned) formed in a lower portion of the inner container 170, and the piston 210 can be raised more smoothly.

Figure 11:
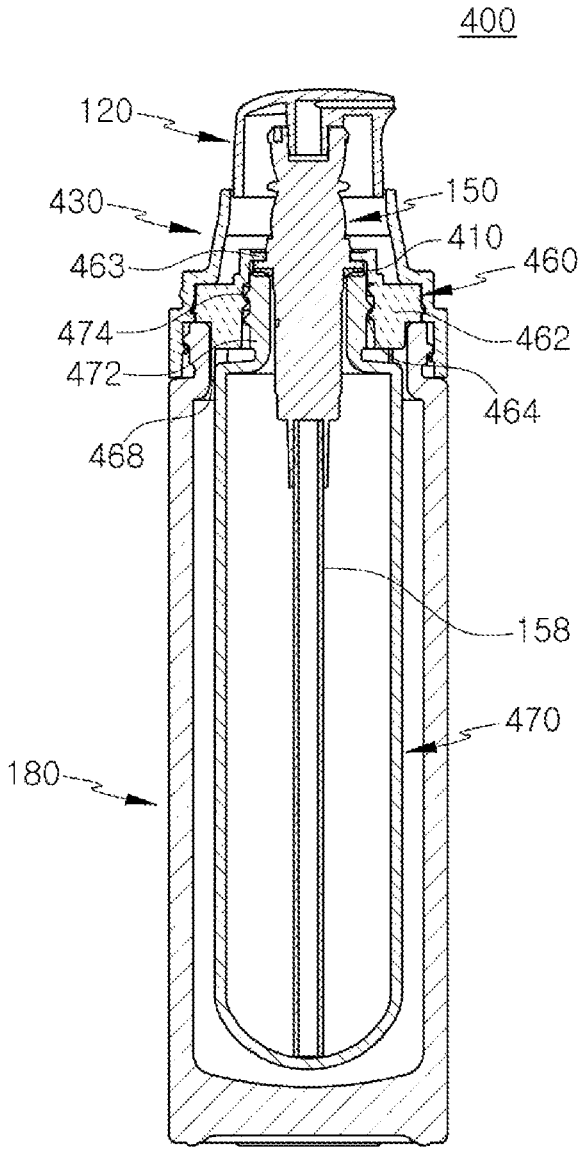
FIG. 11 is a cross-sectional view illustrating a cosmetic container according to a fourth disclosed embodiment of the invention.
Figure 12:
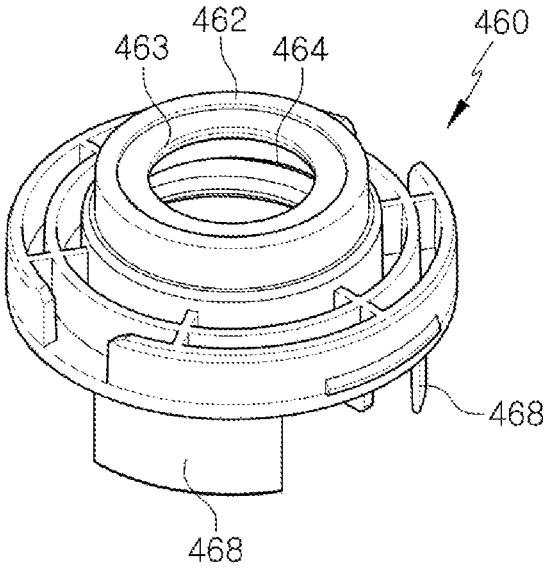
FIG. 12 is a cross-sectional view illustrating the pump support of the cosmetic container shown in FIG. 11.

FIG. 11 is a cross-sectional view illustrating a cosmetic container 400 according to a fourth disclosed embodiment of the invention, and FIG. 12 is a cross-sectional view illustrating the pump support 460 of the cosmetic container 400 shown in FIG. 11.

Referring to FIGS. 11 and 12, a cosmetic container 400 according to the fourth disclosed embodiment may be the same as or similar to a cosmetic container 100 according to the first disclosed embodiment, except that the structures of the shoulder 430, the pump support 460, and the inner container 470 may be modified.

The shoulder 430 may be the same as the shoulder 130 of a cosmetic container 100 according to the first disclosed embodiment in terms of downwardly pressing the pump support 460. Further, in the shoulder 430 according to this embodiment, the shoulder protrusion 138 at the center may be omitted.

The inner container 470 may be inserted inside the outer container 180 and may have a content (not shown) injected therein, to be replaced later when the content is used up. The inner container 470 may include an inner container head 472 at its upper portion, and a screw thread 474 may be formed in the outer perimeter of the inner container head 472.

At an upper portion of the inner container head 472, a ring-shaped packing 410 can be positioned. The packing 410 may be positioned between the flange 152 of the pump 150 and the upper portion of the inner container head 472 to prevent foreign substances from entering the inside of the inner container 470 or prevent the content from leaking out. The packing 410 can be formed from a material such as plastic resin, rubber, silicone, etc.

The pump support 460 may include a support body 462, and the pump 150 may be inserted through a through-hole (no numeral assigned) formed in the center of the support body 462. A pressing protrusion 463 may protrude inward at the inner perimeter of an upper portion of the support body 462. The pressing protrusion 463 may downwardly press the flange 152 of the pump 150. Also, in the inner perimeter of the support body 462, a coupling thread 464 may be formed, which may be coupled with the screw thread 474 formed in the outer perimeter of the inner container head 472.

The pump support 460 may include a support protrusion 468 that protrudes downward. A multiple number of support protrusions 468 can be arranged in a particular interval. The support protrusions 468 may be placed between the outer container 180 and the inner container 470 to prevent the inner container 470 and outer container 180 made from a glass material from being damaged by an impact.

Figure 13:
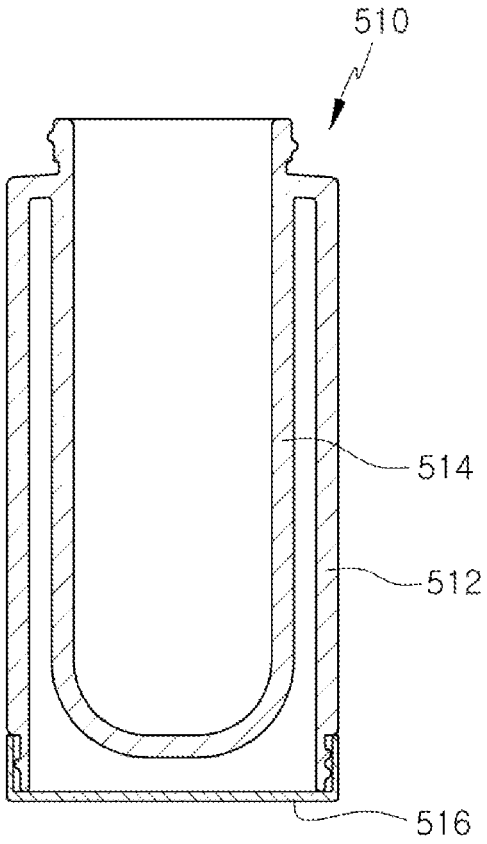
FIG. 13 is a cross-sectional view illustrating the body of a cosmetic container according to a fifth disclosed embodiment of the invention.
Figure 14:
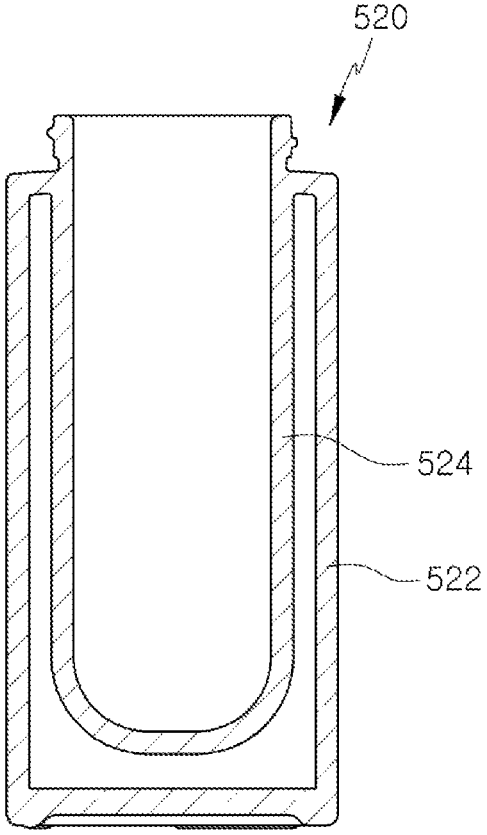
FIG. 14 is a cross-sectional view illustrating the body of a cosmetic container according to a sixth disclosed embodiment of the invention.

FIG. 13 and FIG. 14 are cross-sectional views illustrating the bodies 510, 520 of cosmetic containers according to a fifth and a sixth disclosed embodiment of the invention.

FIG. 13 illustrates a body 510 in which the outer container 512 and the inner container 514 are formed as an integrated body. This type of body 510 can be formed from a glass material, where the inner container 514 and the outer container 512 can be formed as an integrated body for reductions in costs associated with molding and assembly. The lower end of the outer container 512 can be structured to allow a screw joining of a cover 516.

FIG. 14 illustrates a body 520 in which the outer container 522 and the inner container 524 are formed as an integrated body. This type of body 520 can be formed from a glass material.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

an outer container;

an inner container separably inserted into the outer container and configured to receive a content injected therein;

a pump support coupled to an upper opening of the inner container and including a support body connecting to an inside of the inner container;

a pump inserted through the support body and configured to discharge the content; and a shoulder separably coupled to an upper portion of the outer container to downwardly press the pump support with respect to the outer container, wherein separating the shoulder from the outer container separates the pump from the support body and enables a replacing of the inner container and the pump support.

2. The cosmetic container of claim 1, wherein the inner container comprises a flange formed around a periphery thereof, the flange configured to catch onto an upper end of the outer container.

3. The cosmetic container of claim 1, wherein the pump comprises a tube.

4. The cosmetic container of claim 1, wherein a ring is positioned between the inner container and the outer container.

5. The cosmetic container of claim 1, wherein the pump support comprises a support protrusion positioned between the outer container and the inner container.

6. The cosmetic container of claim 1, wherein the inner container comprises an inner container head, the pump comprises a flange positioned over an upper portion of the inner container head, and a packing is positioned between the inner container head and the flange.

7. The cosmetic container of claim 1, wherein a lower end of the inner container has a semispherical shape.

8. The cosmetic container of claim 1, wherein the outer container is fabricated from a plastic or glass material, and the inner container and the pump support are fabricated from a plastic or glass material.

9. The cosmetic container of claim 8, wherein the inner container, the pump support, the pump, and the shoulder are fabricated from a same plastic material.

10. The cosmetic container of claim 1, wherein the pump comprises a piston movably inserted within the inner container.

11. The cosmetic container of claim 10, wherein the piston comprises a piston body having a hollow semispherical shape.

12. The cosmetic container of claim 1, wherein the pump comprises a flange, the shoulder comprises a shoulder protrusion, a support protrusion and mounting protrusions are formed on an inner perimeter of the shoulder protrusion, the mounting protrusions formed in a particular interval below the support protrusion, and the flange is positioned between the support protrusion and the mounting protrusions.

13. The cosmetic container of claim 12, wherein the support protrusion comprises a downwardly sloping surface.

* * * * *